United States Patent [19]

Owens

[11] 4,123,812

[45] Nov. 7, 1978

[54] DECORATIVE SPLASH RAILS FOR BOATS

[76] Inventor: Kenneth F. Owens, Koger Executive Center, Albany Bldg., 8400 NW. 52 St., Suite #218, Miami, Fla. 33166

[21] Appl. No.: 781,153

[22] Filed: Mar. 25, 1977

[51] Int. Cl.[2] ..... B60R 13/04

[52] U.S. Cl. ..... 9/1.1; D11/157; 428/31; 428/137; 428/159; 428/354; 428/16; 428/913

[58] Field of Search ..... 114/219; 248/345.1; D12/62, 70; 428/16, 31, 76, 174, 215, 79, 914, 187, 137, 159, 354, 913; 9/1.1–1.7, 6; 293/1; D11/157

[56] References Cited

U.S. PATENT DOCUMENTS

| | | | |
|---|---|---|---|
| 398,389 | 2/1889 | Gould | 114/219 |
| 1,484,264 | 2/1924 | Heerwagen | 428/187 |
| 2,341,563 | 2/1944 | Tuve | 428/913 X |
| 2,592,011 | 4/1952 | Colston | 9/1.7 |
| 2,780,195 | 2/1957 | Kiekhaefer | D12/70 X |
| 2,817,859 | 12/1957 | McCarthy, Jr. | 9/1.5 |
| 3,475,259 | 10/1969 | Meserole | 428/189 |
| 3,528,873 | 9/1970 | Scholl et al. | 428/71 |
| 3,590,768 | 7/1971 | Shanok | 428/31 X |
| 3,616,104 | 10/1971 | Kuzmick | 428/17 |
| 3,661,690 | 5/1972 | Taranto | 428/69 X |
| 3,782,768 | 1/1974 | Moore | 114/219 X |
| 3,881,042 | 4/1975 | Ungerer | 428/31 X |
| 3,916,055 | 10/1975 | Wagner | 428/31 X |

FOREIGN PATENT DOCUMENTS

| | | | |
|---|---|---|---|
| 1,395,175 | 5/1975 | United Kingdom | 428/24 |

*Primary Examiner*—Henry F. Epstein
*Attorney, Agent, or Firm*—Robert D. Farkas

[57] ABSTRACT

A decorative splash rail for boats utilizes a sheet material formed into a longitudinal three dimensional shape having the marginal edges thereof directed towards each other residing in a plane forming a mounting surface. The cavity formed by the sheet and the mounting surface is filled with a rubber-like closed cell foam material providing buoyancy for the apparatus in the event of accidental dislodgement from the side walls of the boat carrying it. A layer of a double faced adhesive is utilized to secure the apparatus to the boat. Drain holes are provided facilitating the removal of excess amounts of water from within the cavity formed by the apparatus and the side wall of the boat. The external surface of the apparatus may bear various colors creating a bright and pleasing design.

4 Claims, 6 Drawing Figures

DECORATIVE SPLASH RAILS FOR BOATS

BACKGROUND OF THE INVENTION

1. The Field of the Invention

This invention relates to decorative and reflective strips and more particularly to that class adapted to be carried by the side walls of vessels.

2. Description of the Prior Art

The prior art abounds with apparatus utilized to decorate and protect vehicles. U.S. Pat. No. 3,590,768 issued on July 6, 1971 to U. Shanok teaches a combination decorative and reflective strip intended for use as border trim for an automobile rear window or at some other such advantageous location wherein said strip which includes an encapsulated aluminum foil, during daylight simulates the appearance of chromium trim and at night has an ecaapsulated strip of reflective tape which reflects light impinging thereon to thereby provide a significant safety function.

U.S. Pat. No. 3,916,055 issued on Oct. 28, 1975 to D. P. Wagner discloses a trim attachment system utilizing thermoplastic adhesive to bond trim, clips, emblems, or the like, to a finished workpiece. The trim attachment may carry a layer of hot melt adhesive or the adhesive material may be produced solely by the isolated heating and reflowing of a thermoplastic paint on the workpiece.

Both of the aforementioned patents suffer the common deficiency of failing to disclose a bouyant decorative trim apparatus principly designed to be secured to the side walls of a boat, presenting a decorative finished appearance and adapted to act as a splash rail, if so desired.

SUMMARY OF THE INVENTION

A primary object of the present invention is to provide a bouyant decorative strip for use on boats.

Another object is to provide a splash rail which may be attached to existing boats, possessing decorative properties.

Still another object is to provide a splash rail which may personalize the decorations affixed to a boat.

Yet another object is to provide a splash rail having an interesting repeated design formed therein.

A further object is to provide a splash rail possessing luminescent properties.

Heretofore, splash rails were formed as part of the hull of a boat or were added to the hull of the boat by fastening outwardly extending flanges of the rail to the side wall of the boat. Such rails were disinteresting in design and appearance serving only as a splash rail without providing decorations to the boat. The present invention combines the functionability required of splash rails with the highly desirable decorative effects which such splash rails may produce. Luminescence adds to the functionability of the apparatus and when coupled with the bouyancy feature, provides a device which is decorative in nature and functional in use.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a sheet material, such as metal or plastic, formed having a curved external surface extending bulging outwardly from a plane defining the outline of repeated patterns.

The marginal edges of the sheet are directed towards one another and reside in the plane forming thereby inwardly directed flanges, whose outermost surfaces are secured to one surface of a layer of double faced adhesive. The interior cavity, formed between the bulge portion of the sheet and the plane, is filled with a rubber-like foamed material having closed independent cells therein, such as foamed-in-place polyurethane. The outline of the elongated strip formed by the sheet may contain a plurality of repeated designs such as simulated wave-crests, a double twisted rope design, a string of fish patterns or the like. A plurality of holes may be located in the curved portion of the apparatus facilitating water drainage. The plastic material or the external surface of the metal material comprising the sheet may possess luminescent properties thereby facilitating the ability of nearby viewers to discern the present invention in darkened lighting conditions.

Figure 1:
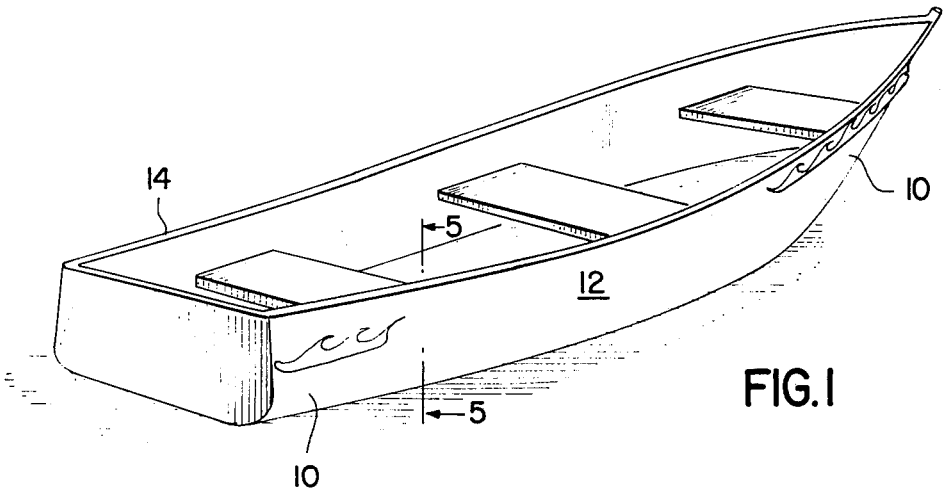
FIG. 1 is a perspective view of the present invention shown secured to the side walls of a boat.

Now referring to the Figures, and more particularly to the embodiment illustrated in FIG. 1 showing the present invention 10 shown mounted to the side wall 12 of a boat 14.

Figure 2:
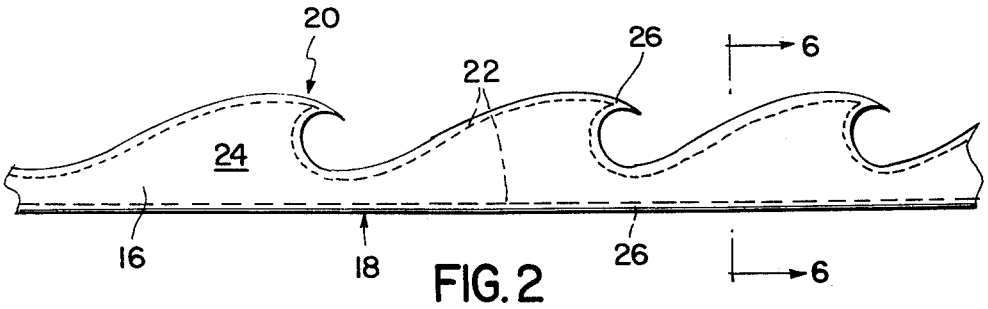
FIG. 2 is a side elevation view of one decorating embodiment of the present invention.

FIG. 2 shows a first decorative embodiment 16 of the present invention shown having a straight outline edge 18 and a wave-crest outline edge 20 defining a series of repetative wave patterns. Dotted lines 22 depict the marginal edges of the sheet that have been turned directed towards each other behind the frontmost surface 24 of the sheet, providing flange-like mounting surfaces 26.

Figure 3:
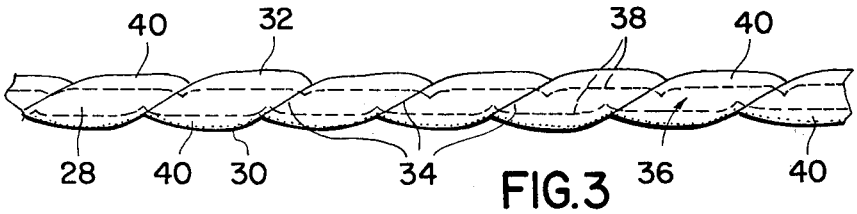
FIG. 3 is a side elevation view of a second decorative embodiment of the present invention.

FIG. 3 shows a second decorative embodiment 28 of the present invention shown having outline edges 30 and 32 defining a pair of twisted ropes. Lines 34 depict depressions in the otherwise outwardly curving exterior surface 36. Dotted lines 38 depict the marginal edges of the sheet that have been turned directed towards each other behind the frontmost surface 36 of the sheet providing flange-like mounting surfaces 40.

Figure 4:
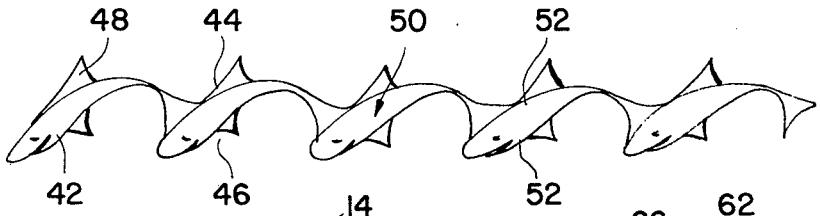
FIG. 4 is a side elevation view of a third decorative embodiment of the present invention.

FIG. 4 shows a third decorative embodiment 42 of the present invention shown having marginal edges 44 and 46 defining a string of connected fishes. Dotted lines 48 depict the marginal edges of the sheet that have been turned directed towards each other behind the frontmost surface 50 of the sheet, providing flange-like mounting surfaces 52.

Figure 5:
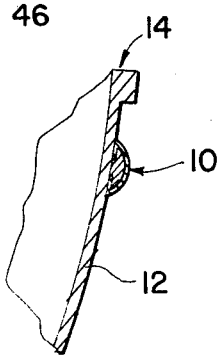
FIG. 5 is a side elevation view taken along line 5—5 viewed in the direction of arrows 5—5 as shown in FIG. 1.

FIG. 5 illustrates the present invention 10 shown secured to side wall 12 of boat 14.

Figure 6:
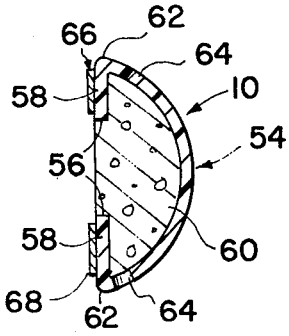
FIG. 6 is a side elevation cross-sectional view taken along line 6—6 viewed in the direction of arrows 6—6 as shown in FIG. 2.

FIG. 6 shows the present invention 10 having an outwardly bulging external surface 54 and marginal edges 56, attached to flange-like mounting surfaces 58, bounding foamed-in-place rubber-like material 60. Flanges 58 reside in a plane defined by the outline of the present invention defined by numeral 62. Holes 64 pass through the walls of the curved portion of the present invention. Double faced adhesive layer 66 and 68 are affixed to the outermost surfaces of flanges 58 and are utilized to secure the present invention to the wall 12 of boat 14, shown in FIG. 1.

One of the advantages of the present invention is to provide a bouyant decorative strip for use on boats.

Another advantage is to provide a splash rail which may be attached to existing boats, possessing decorative properties.

Still another advantage is to provide a splash rail which may personalize the decorations affixed to a boat.

Yet another object is to provide a splash rail having an interesting repeated design formed therein.

A further advantage is to provide a splash rail possessing luminescent properties.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows.

I claim:

1. A decorative splash rail for boats comprising an elongate sheet, said sheet having one external surface including a decorative repeated design thereon along the length of said sheet, a portion of said one external surface of said sheet defining the marginal edges of said design, said portion of said one external surface having a curvature bulging outwardly from the remaining portions of said one external surface, a bouyant closed cell rubber-like material disposed within the cavity formed by said curvature, said remaining portion of said one external surface extending in a plane and contacting at least a portion of the surface of said rubber-like material, said remaining portion of said one external surface defining marginal edges, wherein said marginal edges of said remaining portions are directed towards each other and residing in said plane and means to secure said sheet to the side walls of a boat.

2. The decorative splash rail for boats as claimed in claim 1 further comprising a plurality of drainage holes passing through said sheet, said drainage holes being located in portions of said sheet having said curvature.

3. The decorative splash rail for boats as claimed in claim 1, wherein said securing means comprises a double faced layer of adhesive fixedly secured to said remaining portions of said sheet adjacent said marginal edges of said remaining portion.

4. The decorative splash rail for boats as claimed in claim 1, wherein said external surface possess luminescent properties.

* * * * *